US006852029B2

(12) United States Patent
Baltz et al.

(10) Patent No.: US 6,852,029 B2
(45) Date of Patent: Feb. 8, 2005

(54) METHOD FOR RETROFITTING GAMING MACHINES TO ISSUE AND REDEEM TICKETS

(75) Inventors: Van F. Baltz, Las Vegas, NV (US); J. Christopher McNamee, Las Vegas, NV (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 0 days.

(21) Appl. No.: 09/968,622

(22) Filed: Oct. 1, 2001

(65) Prior Publication Data

US 2002/0111206 A1 Aug. 15, 2002

Related U.S. Application Data

(63) Continuation-in-part of application No. 09/945,566, filed on Aug. 30, 2001, now abandoned, which is a continuation-in-part of application No. 09/693,183, filed on Oct. 19, 2000, now Pat. No. 6,676,515.

(51) Int. Cl.[7] ..... A63F 9/24

(52) U.S. Cl. ..... 463/25; 463/40

(58) Field of Search ..... 463/16, 29, 40–42, 463/17–22, 25, 36; 710/8–19, 62, 63, 64; 273/138.1, 138.2, 143 R, 139; 705/16–18, 14; 902/23; 235/375–382; 221/92, 98

(56) References Cited

U.S. PATENT DOCUMENTS

| | | | |
|---|---|---|---|
| 4,072,930 A | 2/1978 | Lucero et al. | 340/152 T |
| 4,283,709 A | 8/1981 | Lucero et al. | 340/147 R |
| 4,517,656 A | 5/1985 | Solimeno et al. | 364/900 |

(List continued on next page.)

FOREIGN PATENT DOCUMENTS

| | | |
|---|---|---|
| AU | 702021 | 1/1996 |
| DE | 3433774 | 3/1986 |
| DE | 4039732 | 8/1992 |
| EP | 0 051 579 | 5/1982 |

(List continued on next page.)

OTHER PUBLICATIONS

Cash Ticket in the amount of $1.00—ticket No. 00010 dated Oct. 19, 2000.

Cash Ticket in the amount of $481.25—ticket No. 0166 validation Oct. 19, 2000.

*Primary Examiner*—Mark Sager
(74) *Attorney, Agent, or Firm*—McAndrews, Held & Malloy, Ltd.

(57) ABSTRACT

A preexisting gaming machine is adapted or retrofitted to print valid tickets for a game player at low cost. The preexisting gaming machine includes a game microprocessor for controlling game operation (e.g., slot machine operation) and includes a cashout signal input. A game interface is fitted to the gaming machine and coupled to the game microprocessor for controlling ticket printing and redemption in conjunction with a central authority. A memory in the game interface stores a pre-loaded ticket validation number received from the central authority. In addition, a ticket printer is fitted into the gaming machine and coupled to the game interface for printing a ticket that includes game credit indicia and pre-loaded ticket validation indicia. The game interface controls printing in response to a cashout signal. After the ticket is printed, the game interface obtains a new pre-loaded validation number in preparation for the next ticket printing event. The preexisting gaming machine is also retrofitted with a bill validator and ticket reader in order to redeem tickets, without making any changes to the game controller. Thus, the casino's investment in the game is preserved, while ticketing capability is seamlessly added to the game at a fraction of the cost of purchasing new games.

12 Claims, 3 Drawing Sheets

U.S. PATENT DOCUMENTS

| | | | | | |
|---|---|---|---|---|---|
| 4,636,951 | A | | 1/1987 | Harlick | 364/412 |
| 5,265,874 | A | | 11/1993 | Dickinson et al. | 273/138 A |
| 5,290,033 | A | | 3/1994 | Bittner et al. | 273/138 A |
| 5,429,361 | A | * | 7/1995 | Raven et al. | 463/25 |
| 5,470,079 | A | | 11/1995 | LeStrange et al. | 273/138 A |
| 5,544,728 | A | * | 8/1996 | Dabrowski | 273/143 R |
| 5,766,075 | A | | 6/1998 | Cook et al. | 463/25 |
| 5,907,141 | A | * | 5/1999 | Deaville et al. | 235/375 |
| 5,954,583 | A | * | 9/1999 | Green | 463/29 |
| 6,044,952 | A | * | 4/2000 | Haggerty et al. | 194/207 |
| 6,048,269 | A | | 4/2000 | Burns et al. | 463/25 |
| 6,139,017 | A | * | 10/2000 | Kawamura | 463/16 |
| 6,251,014 | B1 | * | 6/2001 | Stockdale et al. | 463/16 |
| 6,254,483 | B1 | | 7/2001 | Acres | 463/26 |
| 6,319,125 | B1 | | 11/2001 | Acres | 463/25 |
| 6,394,907 | B1 | * | 5/2002 | Rowe | 463/42 |

FOREIGN PATENT DOCUMENTS

| | | |
|---|---|---|
| EP | 0 208 857 | 1/1987 |
| EP | 0 219 306 | 4/1987 |
| EP | 0 588 625 A1 | 3/1994 |
| GB | 1 545 301 | 5/1979 |
| GB | 2 151 054 A | 7/1985 |
| GB | 2 236 423 A | 4/1991 |
| GB | 2 241 098 A | 8/1991 |
| GB | 2 282 690 A | 4/1995 |
| WO | WO 98/35309 | 8/1998 |
| WO | WO 98/40140 | 9/1998 |

* cited by examiner

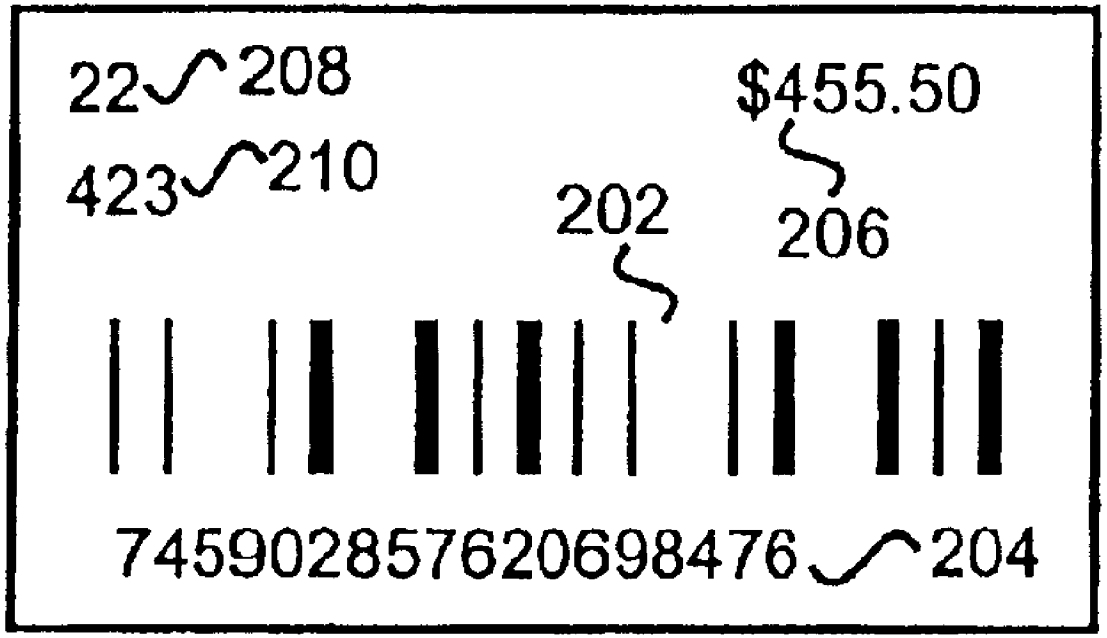
Figure 2
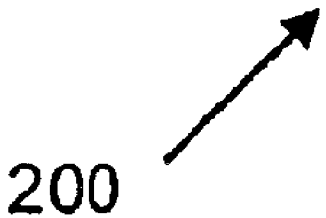

METHOD FOR RETROFITTING GAMING MACHINES TO ISSUE AND REDEEM TICKETS

CROSS-REFERENCE TO RELATED APPLICATIONS

The application is a Continuation-In-Part of U.S. patent application Ser. No. 09/945,566 filed Aug. 30, 2001 now abandoned, which is a Continuation-In-Part of U.S. patent application Ser. No. 09/693,183 filed Oct. 19, 2000, now U.S. Pat. No. 6,676,515.

STATEMENT REGARDING FEDERALLY SPONSORED RESEARCH OR DEVELOPMENT

Not applicable.

FIELD OF THE INVENTION

The present invention relates generally to a gaming system and, more particularly, to a gaming system that provides for cash-less play through printing and redeeming of tickets, and more particularly relates to ticket validation by validation numbers which are pre-loaded by a central computer system to individual gaming machines. More particularly, a pre-existing gaming machine may be retrofitted with a ticket reader, a ticket printer, and game interface board for printing and validation of tickets. By isolating ticket reading, bill validation, and ticket printing functions from the game controller and putting those functions in a separate game interface board, an inexpensive retrofit to ticket compatibility of an existing, non ticket capable game is possible without expensive redesign of the game itself and time consuming re-approval by regulators of the game.

BACKGROUND OF THE INVENTION

Gaming machines, particularly slot machines, have in recent years become one of the more popular, exciting, and sophisticated wagering activities available at casinos and other gambling locations. At the same time, slot machines have also become a source of greater revenue for gaming establishments.

Typically, a player, when finished playing, "cashes out" at the slot machine by activating a cashout button. At that time, the slot machine converts the amount of credits pending in the slot machine to a currency payout that is dispensed (e.g., as coins) to the player. The player must then collect all of the coins, fill a cup or pockets, then move to the next slot machine and reenter all of the coins. Thus, the prior payout techniques tended to interrupt gameplay, thereby reducing profits and also reducing the excitement and entertainment experience that arise from uninterrupted game play.

In the past, slot machines have attempted to address the interruption caused when a player collects coins and moves to another slot machine. In particular, some slot machines have issued paper tickets that encode the amount of credit pending in the slot machine when the player presses the cashout button. The player may then simply pick up the ticket dispensed by the slot machine and proceed to a new slot machine without incurring the time delay and distraction associated with collecting currency and reinserting it into the new slot machine.

Successful ticketing, however, requires a comprehensive system level approach to ensure that the tickets are secure (e.g., they cannot be duplicated and reused, they cannot be forged, and the like), that as many slot machines as possible can accept tickets, and that ticketing does not cause as much interruption as the coin/currency payout that the tickets are designed to replace. However, in prior ticketing systems for example, the slot machines typically had to spend the time and processing resources to generate their own ticket validation numbers, or had to incur the delay of requesting a ticket validation number from a central authority each time the slot machine needed to print a ticket. As a result, prior slot machines exposed the player to unnecessary processing delay, thereby slowing play, and reducing the overall level of player enjoyment.

In addition, preexisting gaming machines do not have the capability to print and redeem tickets, making them apparently obsolete in a ticket environment. A player having received a printed ticket from one gaming machine, crosses the casino floor only to find that the next machine of choice is unable to redeem the ticket. This causes player frustration and potential confusion as to the purpose of the ticket. The cost of replacing every machine on the floor with new machines that can handle tickets is very high, since a large casino may have over 3,000 machines with a replacement cost of $10,000 and up for each machine.

It is therefore an object of this invention to solve the need for a secure ticket actuated gaming system that addresses the problems noted above and other problems previously experienced.

It is yet another object of the present invention to retrofit pre-existing gaming machines or systems, to provide for ticket type cashless play.

It is therefore an object of the invention to provide a method for retrofitting preexisting gaming machines.

It is therefore an object of the invention to provide a retrofit kit that enables the retrofitting of a gaming machine.

It is another object to provide a cost-effective upgrade for gaming machines that do not have ticketing capabilities.

It is another object to provide a retrofit upgrade that does not require any changes to the basic game hardware and software.

SUMMARY OF THE INVENTION

The invention is useful in a method of retrofitting for ticketing a gaming machine incapable of ticketing, the gaming machine comprising a credit meter and a game controller arranged to control play of the game, the gaming machine being arranged to generate a cashout signal initiated by a player of the gaming machine and to direct the cashout signal to the game controller. In such an environment, the method may include installing a game interface arranged to provide communication between the gaming machine and a central authority in the event no such interface is used in connection with the gaming machine and may include providing communication between the credit meter and the game interface. In the event that a game interface arranged to provide communication between the gaming machine and a central authority is used in connection with the gaming machine, the game interface may be modified to accommodate ticketing. The game cashout signal may be redirected from the game controller to the game interface. A ticket reader capable of reading tickets printed by a ticket printer may be installed in the event no such ticket reader is used in connection with the gaming machine, and the ticket reader may be coupled to the game interface, the interface providing data to the credit meter in response to reading the tickets. In the event that a ticket reader capable of reading tickets printed by a ticket printer is used in connection with the gaming machine, the ticket reader may be recoupled from the game controller to the game interlace.

A ticket printer may be added to the gaming machine capable of printing tickets readable by the ticket reader, and the ticket printer may be coupled with the game interface, the credit meter providing data to the interface for printing the tickets. A monetary or credit transfer feature may be enabled to be recognized by the credit meter in the event that such a feature is not enabled in connection with the gaming machine.

The invention also is useful in a method of retrofitting for ticketing a gaming machine incapable of ticketing, the gaming machine comprising a credit meter, a game controller arranged to control play of a game, a bill validator coupled to the game controller and a game interface arranged to provide communication between the gaming machine and a central authority, the gaming machine being arranged to generate a cashout signal initiated by a player of the gaming machine. In such an environment, the method may include recoupling the bill validator from the game controller to the game interface, adding ticket reading software to the bill validator if necessary, adding a ticket printer for use with the gaming machine, coupling the game interface with the ticket printer, the credit meter providing data to the game interface for printing the tickets, divorcing the game controller of control over the game cashout signal, and coupling the cashout signal to the game interface.

BRIEF DESCRIPTION OF THE DRAWINGS

FIG. 2 shows a front view of a ticket used with the gaming system of FIG. 1 and FIG. 3.

DETAILED DESCRIPTION OF THE PREFERRED EMBODIMENT

Figure 1:
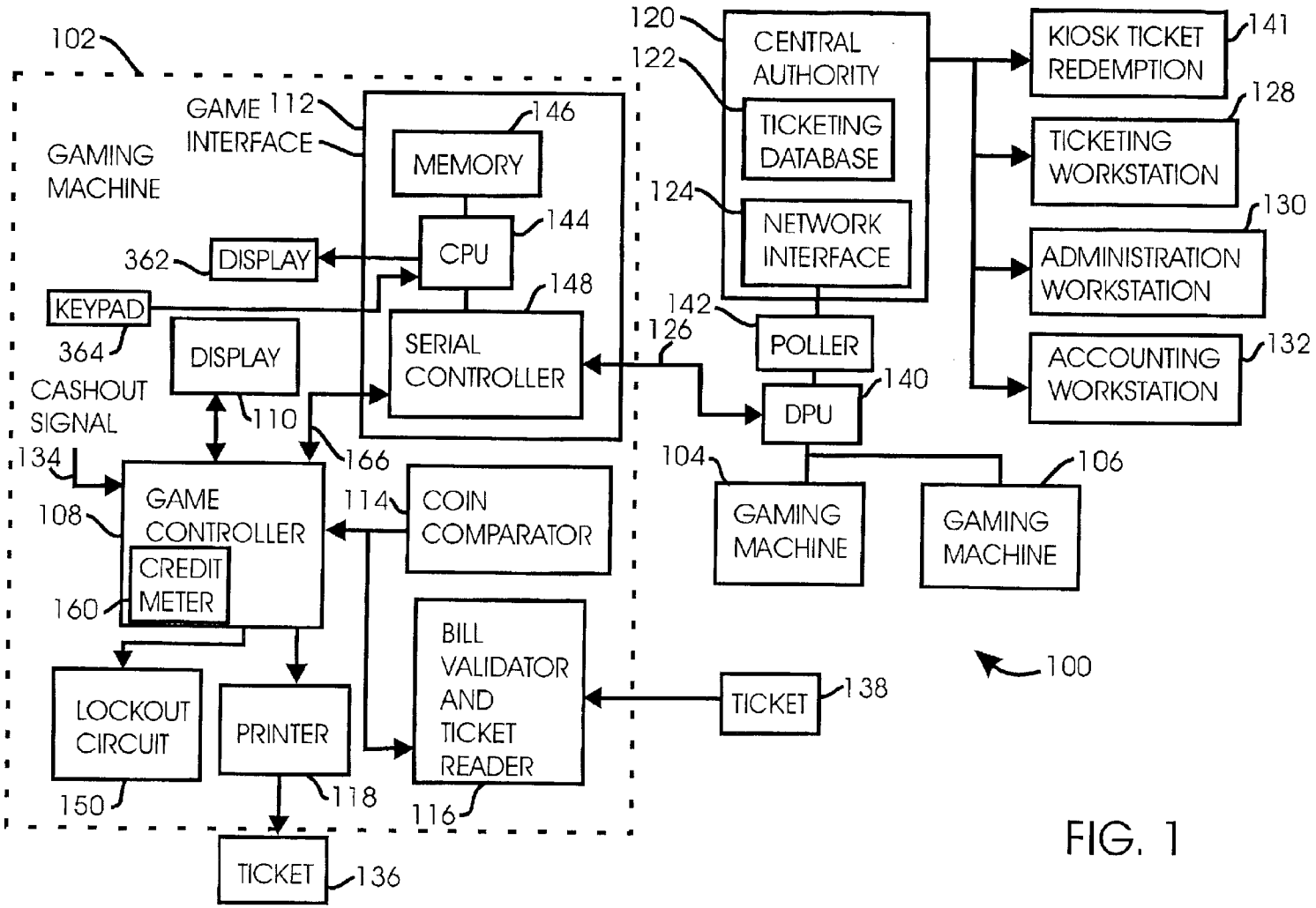
FIG. 1 illustrates a block diagram of a gaming system for ticketing, where the game controller controls ticketing functions.

Referring to FIG. 1, a gaming network 100 includes several gaming machines 102, 104, 106. The gaming machines 102–106 may be implemented, for example, as slot machines, video poker machines, video roulette machines, and the like. Each gaming machine 102–106 includes a game controller 108, a display 110, and a game network interface 112. The game controller 108 is typically a microprocessor driven "motherboard" that contains video processing logic, the game logic, control for all of the game I/O, a random number generator, and control of the game "tilt" or lockout circuit 150 and cashout signal 134. The game controller may communicate with game interface 112 across a serial link 166. Game controller 108 is unique to each manufacturer and may differ radically from model to model of game even when the games are made by the same manufacturer.

The game interface 112 may be, for example, an RS485 interface such as that implemented by a Sentinel™ Interface from Aristocrat Technologies. Other interfaces and network architectures (e.g., Ethernet, parallel port, and the like) may be substituted however. Furthermore, the game interface 112 may adhere to, for example, the IGT Gaming SAS™ communication protocol, the CDS GDAP™ communication protocol, a custom protocol, or another third party communication protocol for establishing and maintaining communication with the game controller 108 of the gaming machine 102. These protocols are available to system designers from the game manufactures. The game interface 112 is physically present inside of the gaming machine 102; although, it may be located externally from and coupled to the gaming machine 102. Each gaming machine 102–106 further includes a coin acceptor or comparator 114, a bill validator/ticket reader 116, and a ticket printer 118.

Gaming machine 102 may be originally manufactured with some or all of these components, or may be retrofitted with some or all of these components, as described below. Initially, the embodiment of FIG. 1 will be described as if the bill validator/ticket reader 116 and ticket printer 118 are originally manufactured within the gaming machine.

The game controller 108 is responsive to a cashout signal 134 to print a ticket 136 on paper, or other suitable material. Additionally, previously printed tickets (e.g., the ticket 138) may be redeemed for credits by the gaming machines 102–106. The gaming network also includes a central authority or host computer system 120. The central authority 120 includes a ticketing database 122 and a network interface 124 for connection over the network medium 126 to the gaming machines 102–106. Support systems connect to the central authority 120, including a ticketing workstation 128, an administration workstation 130, an accounting workstation 132, and Kiosk Ticket Redemption 141. Kiosk Redemption 141 provides a location where patrons can redeem tickets 136 for cash away from the gaming machine, such as at a cashier cage.

A dataport unit (DPU) 140 is provided as a data concentrator and buffering communication unit to address multiple gaming machines and to communicate with the poller 142. The poller 142, in turn, communicates with the DPU 140 and the central authority 120. The game interface 112 may be generally configured as shown in FIG. 1 to include a CPU 144, a program and data memory 146, and a serial controller 148. Program and date memory 146 may consist of both EPROM for holding the game interface firmware or program instructions and a non-volatile static RAM for holding parameter information.

The game controller 108 is responsible for operation of the gaming device 102. Thus, the game controller 108 may include a microprocessor, memory, game software, and support circuitry to implement a slot machine or other type of game. The display 110 presents to the player a representation of the pending credit in the gaming machine 102 that is stored in the game controller's 108 credit meter 160 (e.g., $455.50 or 911 credits). During play, the game controller 108 tracks the pending credit according to the rules of the game and the interaction with the player (including the deposit of additional funds via the coin acceptor 114 and bill validator 116), and further monitors for assertion of the cashout signal 134. Thus, the central authority 120 need not monitor the pending credit in each gaming machine 102–106, as each gaming machine 102–106 preferably tracks the pending credit locally and independently of the central authority 120.

In response to the cashout signal 134, the game controller 108 prints the ticket 136 which may be redeemed later at gaming machines 102–106 or at independent workstations with ticket readers. The cashout signal 134 may be generated by a player actuated switch, touchscreen input, or the like. As will be explained in more detail below, the game controller 108 prints the ticket 136 with a pre-loaded ticket validation number obtained from the central authority 120 through the network interfaces 112, 124 and over the network medium 126. The central authority 120 may use a number generator to generate validation numbers, and, if desired, may use an encryption algorithm to generate the validation numbers. The number generated may be based on, for example, the time and/or date as well as the gaming machine number.

The ticketing database 122 stores information obtained from the gaming machines 102–106, as well as locally generated validation numbers. The ticketing workstation 128 provides cash redemption of tickets separate from the gaming machines, the administration workstation 130 provides an interface for setting up system parameters, and the accounting workstation 132 provides for ticket and gaming machine accounting functions. Note that in general, when a ticket validation number is pre-loaded into a game interface 112, the ticket validation number is also stored in ticketing database 122 (albeit without an associated pending credit amount). Thus, should the gaming network fail, validation may still occur through human intervention.

Turning next to FIG. 2, a ticket 200 includes a validation number bar code 202 (e.g., in JCM or Code 205 format), a human intelligible validation number 204, and a human intelligible pending credit amount 206. The ticket 200, as shown, also includes a machine number 208 and a ticket number 210 (e.g., a sequential ticket number generated in the gaming machine 102). The validation number bar code 202 is a machine readable representation of a pre-loaded validation number (as discussed in more detail below) but the validation number bar code 202 generally does not encode other information (e.g., the pending credit amount). In other words, the ticket 200, when it is advantageous to do so, may omit a machine readable pending credit amount. Additional information may also be printed on the ticket 200, including a date/time of cashout, casino name, ticket expiration date, and the like.

In using the system of FIG. 1, a player presses a cashout button and thereby generates the cashout signal 134. In response to the cashout signal 134, game controller 108 proceeds to obtain a pre-loaded validation number from the game interface 112 and to print ticket 136. The game controller 108 sends the necessary information to ticket printer 118 and the ticket is printed.

Information regarding the printed ticket is sent to the central authority 120 through the game interface 112. The printed ticket information may include the casino name, ticket date and time, validation number, a bar code representing the validation number, a numeric pending credit amount, an alphanumeric description of the pending amount, a machine number, and a ticket number (typically up to 9999 and sequentially generated at each gaming machine). The game interface 112 also requests a new ticket validation number from the central authority 120, and pre-loads it into a memory (e.g., the memory 146) for use when the next ticket is printed. Thus, a ticket validation number is immediately available at the gaming machine when the player activates the cashout button.

The ticketing database 122 in the central authority may store, for example, a number of fields as desired. Examples of fields are set forth in Tables 1, 2 and 3 of parent application Ser. No. 09/693,483, the entirety of such application is incorporated herein by reference.

Also, in using the system in FIG. 1, a player may insert a ticket 138 into a gaming machine 102–106. The gaming machine queries the central authority 120 for validation of the validation number bar code 202 printed on the ticket. In general, the pending credit printed on the ticket is not read by the ticket reader. Rather, the system itself responds with the pending credit as explained below.

The central authority attempts to find the validation number in its ticketing database 122. If the validation number is not found, the system responds to the gaming machine with a Reject Message. If the ticket is a duplicate, i.e., it has been validated earlier, the system also responds with a Reject Message. If the validation number is not a duplicate, then the system determines whether the ticket status as recorded in the ticketing database 122 is issued and redeemable (i.e., it has not already been redeemed for money). If not, the system again responds with a Reject Message. The ticket/bill validator 116 then rejects the ticket, i.e., returns the ticket to the player.

If the ticket is valid, the central authority responds to the gaming machine via the game interface 112 to indicate that the ticket is valid and provides the amount to be credited (e.g., in cents). The gaming machine loads the amount into its credit meter 160.

Subsequently, the gaming machine replies to the central authority with the ticket processing result (e.g., the ticket was rejected or accepted). The central authority changes the ticket status in the ticketing database 122 to indicate, for example, that the ticket has been redeemed.

Prior to the applicant's invention, it was not thought possible to economically retrofit existing, non-ticket capable games to ticketing because to add these features required changes to the game controller 108. Non-ticket capable games generally have the configuration of game 102 in FIG. 1 except that there is no printer 118 and the bill validator 116 does not have ticket reading capability. Game controller 108 controls the actual outcome of the game and is highly regulated by gaming authorities. In existing, non-ticket capable games, the game controller has exclusive control of the bill validator 116 and also is tightly integrated with certain contact closure events, such as the cashout signal 134 and the game lockout circuit 150. Reworking the game controller to accommodate ticketing in older machines would require reworking the game logic, communications, and I/O of each game to accommodate ticket reading and printing, adding communications support for the printer, and altering the credit logic to accommodate problems unique to tickets, such as odd value tickets, cashing out to the ticket printer instead of the game coin hopper, and recognizing faults in the printer and ticket reader hardware. Since each game type would have to be engineered and then approved by the gaming authorities, the cost to make the necessary changes is potentially larger than the cost of a new game for many game types.

Figure 3:
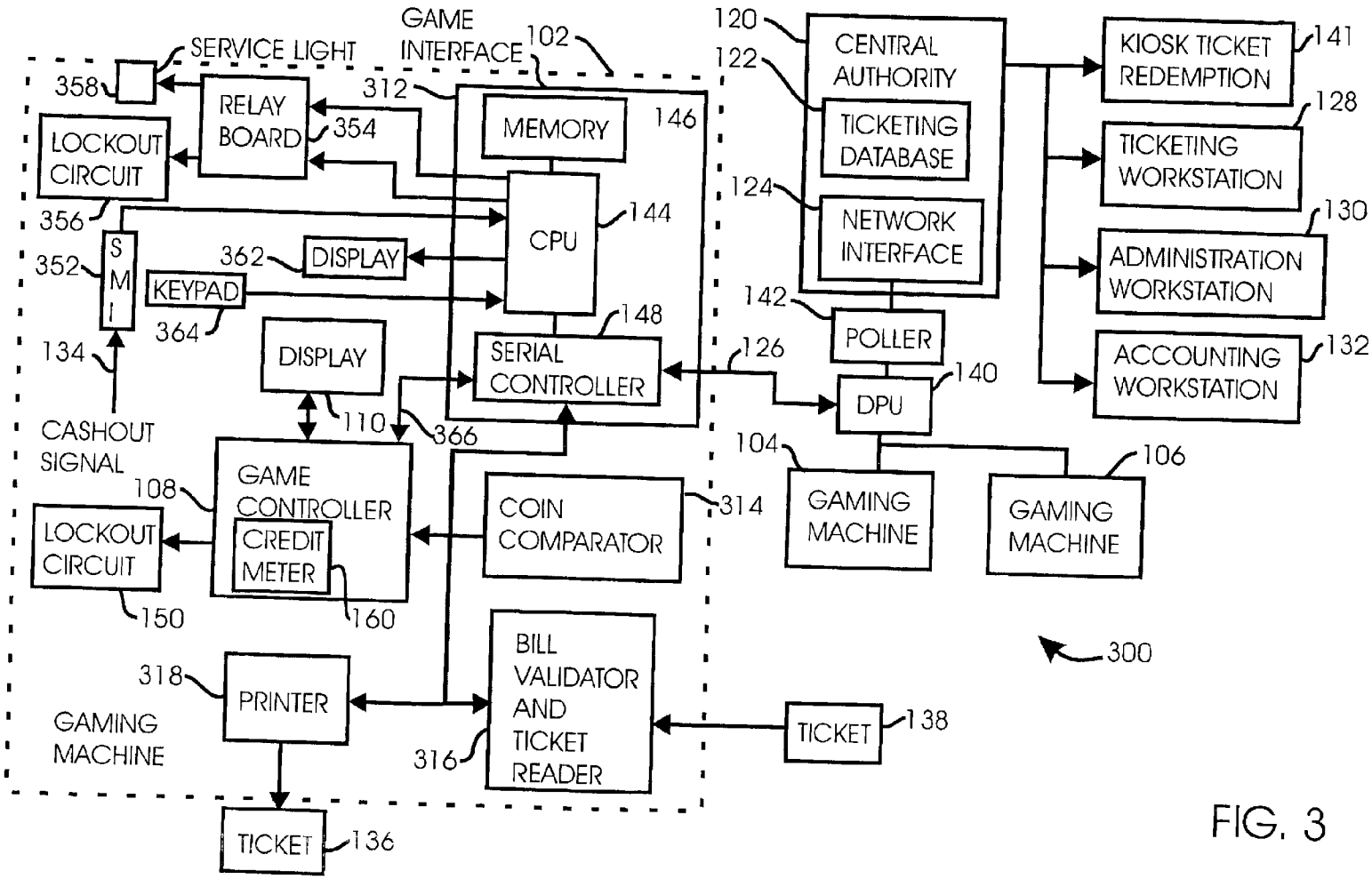
FIG. 3 illustrates a block diagram of the present invention in which a central authority or game interface exercises direct control over a bill validator, a ticket printer, and a ticket reader of the individual gaming machine.

FIG. 3 shows a solution to the problem of how to inexpensively retrofit the enormous installed base of non-ticket compatible games. The inventors have realized that a complete, economical retrofit of most games can be accomplished by exploiting the fact that the game controller 108 does not have to be aware of the source of game credit. Accordingly, the existing game controller can be physically and logically divorced from the bill validator and game cashout signal. Ticket reading software can be added to the bill validator and ticket reader 316. By then adding a ticket printer and serially connecting the game interface board directly to the bill validator and ticket printer, and divorcing the game controller of control over the game cashout signal, it is possible to then add the ticket reading/printing function to the EPROM software in the game interface board 312, connect the bill validator/ticket reader and an added printer 318 to the serial controller 148 on the game interface board 312, reconnect the cashout signal 134 through a Slot Machine Interface board 352 to the CPU 144, and program the game interface board 312 to add and subtract credits based on ticket in, bill in, and cashout 134 events from the game controller's credit meter 160 using the existing Electronic Funds Transfer or Electronic Money Transfer ("EFT") protocols already built into the communications of most existing game controllers through serial link 366. Because most existing slot machines already have a game interface board 112 installed for casino slot accounting and monitoring purposes, the only new hardware usually required for this retrofit strategy is the ticket printer 318, and possibly the bill validator and ticket reader 316 if the machine does not already have a bill validator. Some additional serial ports may need to be added to the game interface board 312 if it does not have extra ports already available. The necessary programming changes to the game interface 312 can be accomplished by providing the necessary software on an EPROM, with additional memory for holding the necessary ticket and bill validation meters provided in the form a non-volatile static RAM (NVRAM or "flash" memory). Even with some minor additional wiring harness changes and adding lockout circuit 356 and service light 358 functionality to the game interface board 112, the total cost across the population of eligible games is low since the retrofit software is the same for most game platforms.

A block diagram of a gaming network 300 illustrates control by a game interface 312 over a bill validator and ticket reader 316, a ticket printer 318, and the cashout signal 134. As will suggest itself, a separate ticket reader and ticket printer may be used, however the functionality of a reader and printer may be incorporated into a single device. FIG. 3 is similar to FIG. 1, and like reference numerals denote like parts. Note, however, that the bill validator and ticket reader 316, ticket printer 318, and cashout signal 134 are connected directly to the game interface 312 rather than to the game controller 108.

As a result, the game interface 312 may exercise control over the bill validator and ticket reader 316, and ticket printer 318 through the game interface 312. Furthermore, the game interface, not the game controller, responds to a game cashout signal 134. The game interface takes over these functions by communicating with the game controller's credit meter 160 using EFT commands defined by SAS, GDAP, or other manufacturer provided game communication protocols that provide a method for an external authority such as central authority 120 to add or subtract credits from the game. The game controller 108 is thereby relieved of those duties, however, the game controller retains direct control of the credit meter 160 for other purposes. In such a retrofit, the coin comparator 314 remains connected to the game controller 108. Thus, the game controller 108 continues to add credits based on coins dropped in the coin comparator 114 and credits won by the player based on a winning game outcome. Pre-existing gaming machines that do not allow convenient game controller ticket printing and reading, may nevertheless issue and redeem tickets when retrofitted with the game interface 312, bill validator and ticket reader 316 and ticket printer 318, without any changes to the game controller itself except for the possible software activation of EFT communications features, which usually can be turned on without any change to the game at all.

Interface 312 includes software in its memory 146 to directly control ticket printer 318 as well as bill validator and ticket reader 316, and to correspondingly communicate with a central authority 120, as described herein. The hardware components of interface 312 may be incorporated onto a single printed circuit board (or several boards, if desired) which is fitted into gaming machine 102. The printed circuit board may replace an existing machine's original interface board so as to retrofit the existing machine to provide ticketing capabilities, or the original interface board can be upgraded with a firmware chip change and additional I/O lines to CPU 144 and serial controller 148. Thus, an existing machine gains the ability to print and redeem tickets. As will suggest itself, apertures may be cut out of the face of the gaming machine in order to locate the typical ticket receiving slot of bill validator and ticket reader 316 and to locate the typical dispensing slot of ticket printer 318. Instructional information may also be printed on the face of the gaming machine, if desired.

Game interface 312 controls the physical cashout button on the gaming machine. As shown in FIG. 3, the cashout signal bypasses game controller 108 and is sent directly to game interface 312 through Slot Machine Interface 352. Slot Machine Interface 352 converts basic contact closure signals such as a button push into logic levels compatible with the I/O lines of CPU 144. When a player presses the cashout button, all credits are removed from the game credit meter 160 with an appropriate EFT instruction to the game controller 108, a validation number is assigned to a ticket, information is logged into the database 122 and the ticket 136 is printed.

The game interface 312 stores a pre-loaded ticket validation number obtained from the central authority 120, as described above in reference to FIG. 1. It is this pre-loaded validation number (202 and 204) that is printed on the ticket. Alternatively, game interface 312 may independently generate the validation number by a number generator as previously discussed. Interface 312 may preload its memory 146 with the number generated.

Upon actuation of the cashout button, a validation number, as well as other information, is sent by game interface 312 to the ticket printer 318 and to the ticketing database 122. Other information sent may include machine number, sequential ticket number, amount, date/time, and expiration date. A ticket similar to that shown in FIG. 2 is then printed. Ticketing database 122 will then have information regarding the particular ticket that may later be used to validate it.

The flow of the process for printing tickets may be described as follows:

1. A player pushes the cashout button on gaming machine 102. The cashout signal 134 is generated and sent to game interface 312.
2. The game interface 312 responds to the cashout signal by removing all credits from the credit meter 160 using EFT. An EFT message is sent by game interface 312 to the game controller 108 to cause the removal of all credits from Credit Meter 160. As will be understood, gaming machine 102 has EFT protocol capabilities.
3. The game interface 312 also provides a validation ticket number and the credit amount to the printer. The validation number is preloaded into interface 312 after generation by the central authority 120. Alternatively, game interface 312 may generate the validation number independently of the central authority, and provide data regarding that generation to the central authority for storage in database 122.
4. Ticket printer 318 prints a ticket and dispenses the ticket to the player.
5. Data is stored in game interface 312 regarding the printing. Game interface 312 keeps a log of all printed tickets with date and time data in non-volatile static RAM, and may keep another log as to printer events.
6. Game interface 312 sends data to central authority 120 regarding the printing, i.e., that the ticket was successfully printed, and a record of the ticket is sent as well.

7. Central authority 120 generates the next validation number to be used by that gaming machine and loads that validation number into game interface 312.

When a ticket 138 is inserted into the bill validator and ticket reader 316, the game interface 312 reads the ticket directly and proceeds to verify the validation number bar code with the central authority 120 as explained above. Valid tickets result in credit being applied to the gaming machine 102 using, for example, an EFT message. The EFT message is preferably generated by the game interface 312. An invalid ticket is rejected, and is returned to the player. In addition, the game interface 312 may also read standard currency (e.g., bills) input to bill validator 316, and appropriately report to the central authority 120 and add credits to the game using an EFT message to game controller 108. Again, the central authority 120 may respond with an EFT message to the gaming machine 102 to apply credit thereto. Alternatively and preferably, the game interface 312 may determine the amount of standard currency inserted and report that amount directly to the gaming machine 102 via an EFT message (to appropriately increment its credit meter 160). Gaming interface 312 may accumulate the bill amounts into memory. In that regard, the game interface 312 may act as a filter, summarizing routine game activity and only generating appreciable network traffic to the central authority 120 when tickets are printed or inserted.

The flow of the process for redeeming tickets may be described as follows:

1. A player inserts a ticket into the bill validator and ticket reader 316.
2. The game interface 312 responds by storing pertinent data and transmitting the ticket's validation number to the central authority 120.
3. Central authority 120 checks its database 122 to determine whether the validation number exists in the database, whether the ticket is a duplicate, and the status of the ticket. If valid, the central authority changes the ticket's status to indicate redemption is in process and then sends the ticket type (cashable) and the amount (cents) to the game interface 312.
4. The game interface 312 tells the ticket reader 316 that the ticket is acceptable and data is stored accordingly. The ticket reader 316 retains the ticket.
5. The game interface 312 sends a credit message to the game via EFT protocol and stores data accordingly.
6. The game controller 108 responds to the EFT message and loads an amount or appropriate number of credits into the credit meter 160 which is displayed at display 110. The game controller 108 may store data and informs interface 312 that credit has been given to the player.
7. The game interface 312 sends data to central authority 120 that the ticket was redeemed.
8. The central authority 120 changes the ticket status to redeemed.

If the ticket is not accepted by the game, the central authority is notified accordingly so that it may change its database to reflect the status of the ticket. If the game is able to accept some, but not all of the ticket amount, the game is able to print a ticket for the difference in order to give "change" back to the player. Some gaming machines can only accept whole dollar amounts, based on the gaming machine's denomination. The game interface 312 may print a change ticket to return the change balance to the player. Game interface 312 prints the change ticket in the same manner it prints a cashout ticket, but using a validation number and communicating with the central authority, as described above. Data is stored in the central authority, accordingly.

Thus, the present invention provides a secure ticket actuated gaming network. In particular, the gaming machines are pre-loaded with ticket validation numbers in preparation for printing a cashout ticket. As a result, the player need not wait while the gaming machine generates or requests a new validation number. Preexisting machines may be retrofit to participate in the ticketing process.

A retrofit kit may be used to retrofit preexisting gaming machines. As used herein, "retrofit" means to furnish a preexisting machine or system with additional parts, either new parts or used parts. A retrofit kit includes a game interface or upgraded chips for the game interface, a ticket printer, and a bill validator and ticket reader or upgraded chips for the existing bill validator, appropriate wiring harness to reconnect the bill validator, printer, and cashout signal to the game interface 312, and a slot machine interface board (SMI board) 352 and Relay Board 354 to allow the game interface to operate a lockout circuit 356 in the event of a game fault condition and/or activate a service light 358 to alert the casino floor personnel. The game interface may include a four port serial I/O daughter board which connects the serial port of the game interface to the ticket printer and bill validator and ticket reader. The game interface will also include the necessary software to perform its functions as described above. As will suggest itself, additional software may be provided so as to permit game interface 312 to display messages on display 362. For example, the message ADDING CREDITS may be displayed to ensure player awareness during the validation process. Other messages may include TICKET ACCEPTED or TICKET REJECTED. Finally, a keypad 364 is provided to allow input directly to the game interface 312. The keypad allows for customer input of PIN numbers and the like, for access by service personnel to the game interface program, and for other maintenance and security functions such as hopper fills and drop area access. When the retrofit is complete, the game operates as before the retrofit with ticket capability added. The game cashout, lockout, and service light signals appear to operate in the same way that they functioned before the retrofit. However, the critical ticket, bill validation, and cashout functions are now actually under the control of the game interface.

The inventors have described a method and apparatus to create bill validation, ticket validation, and ticket redemption functionality in a gaming device that was not designed to accommodate those functions by adding the ticket and validation program software to a game interface board that is independent of the game controller. The invention exploits the fact that the game control logic will operate correctly regardless of how credit is applied to the game credit meter 160. The game interface takes control of the bill and ticket validator and ticket printer and uses EFT protocols as a proxy for the credit instructions that are normally generated by the game controller in response to bill and coin inputs. The ability to correctly print tickets is ensured by transferring control of the game cashout signal from the game controller to the game machine interface.

While the invention has been described with reference to particular embodiments, those skilled in the art will understand that various changes may be made and equivalents may be substituted without departing from the scope of the invention. In addition, many modifications may be made to adapt a particular step, structure, or material to the teachings of the invention without departing from its scope. Therefore, it is intended that the invention not be limited to the particular embodiments disclosed, but that the invention will include all embodiments falling within the scope of the appended claims.

What is claimed is:

1. A method of retrofitting for ticketing a gaming machine incapable of ticketing, the gaming machine comprising a credit meter and a game controller arranged to control play of the game, the gaming machine being arranged to generate a cashout signal initiated by a player of the gaming machine and to direct the cashout signal to the game controller, the method comprising the steps of:

installing a game interface arranged to provide communication between the gaming machine and a central authority in the event no such interface is used in connection with the gaming machine and to provide communication between the credit meter and the game interface;

in the event that a game interface arranged to provide communication between the gaming machine end a central authority is used in connection with the gaming machine, modifying the game interface to accommodate ticketing;

redirecting the game cashout signal from the game controller to the game interface;

installing a ticket reader capable of reading tickets printed by a ticket printer in the event no such ticket reader is used in connection with the gaming machine and coupling the ticket reader to the game interface, the interface providing data to the credit meter in response to reading the tickets;

in the event that a ticket reader capable of reading tickets printed by a ticket printer is used in connection with the gaming machine, recoupling the ticket reader from the game controller to the game interface;

adding a ticket printer to the gaming machine capable of printing tickets readable by the ticket reader and coupling the ticket printer with the game interface, the credit meter providing data to the interface for printing the tickets; and enabling a monetary or credit transfer feature to be recognized by the credit meter in the event that such a feature is not enabled in connection with the gaming machine.

2. The method of claim 1, wherein the ticket printer is incorporated into the bill validator.

3. The method of claim 1, wherein the monetary or credit transfer feature comprises electronic funds transfer or electronic money transfer protocols.

4. The method of claim 1, and further comprising coupling the game interface to a relay board for controlling a game tilt switch.

5. The method of claim 1, and further comprising upgrading the game interface board by adding new program instructions and static RAM.

6. The method of claim 1 wherein the ticket reader comprises a bill validator.

7. The method of claim 6 and further comprising providing program instructions to the bill validator that allow the bill validator to read tickets in the event the bill validator before providing said program instructions was unable to read tickets.

8. A method of retrofitting for ticketing a gaming machine incapable of ticketing, the gaming machine comprising a credit meter, a game controller arranged to control play of a game, a bill validator coupled to the game controller and a game interface arranged to provide communication between the gaming machine and a central authority, the gaming machine being arranged to generate a cashout signal initiated by a player of the gaming machine, the method comprising the steps of;

recoupling the bill validator from the game controller to the game interface;

adding ticket reading software to the bill validator if necessary;

adding a ticket printer for use with the gaming machine;

coupling the game interface with the ticket printer, the credit meter providing data to the game interface for printing the tickets;

divorcing the game controller of control over the game cashout signal; and coupling the cashout signal to the game interface.

9. The method of claim 8, wherein the ticket printer is incorporated into the bill validator.

10. The method of claim 8, and further comprising coupling the game interface to a relay board for controlling a game tilt switch.

11. The method of claim 8, and further comprising upgrading the game interface board by adding new program instructions and static RAM.

12. The method of claim 8, wherein the divorcing comprises eliminating the control of the game controller over the game cashout signal.

* * * * *

UNITED STATES PATENT AND TRADEMARK OFFICE

CERTIFICATE OF CORRECTION

PATENT NO. : 6,852,029 B2
APPLICATION NO. : 09/968622
DATED : February 8, 2005
INVENTOR(S) : Van F. Baltz and J. Christopher McNamee It is certified that error appears in the above-identified patent and that said Letters Patent is hereby corrected as shown below:

Title page, item (63) Related U.S. Application Data

Please delete the entire paragraph and insert --This application is a Continuation-in-Part of U.S. Patent Application Serial No. 09/693,183 filed October 19, 2000, now Pat. No. 6,676,515--.

Title page, item 63 Column 1, "Cross Reference to Related Applications", please delete the entire paragraph and insert --This application is a Continuation-in-Part of U.S. Patent Application Serial No. 09/693,183 filed October 19, 2000--.

Signed and Sealed this

Eighteenth Day of December, 2007

JON W. DUDAS
*Director of the United States Patent and Trademark Office*